United States Patent [19]

Goto et al.

[11] Patent Number: 4,819,003

[45] Date of Patent: Apr. 4, 1989

[54] FLAT CIRCULAR UNIDIRECTIONAL MICROWAVE ANTENNA

[76] Inventors: Naohisa Goto, No. 6-15-1-A514, Tsuchihashi, Takatsu-Ku, Kawasaki-Shi, Kanagawa-Ken; Yoshiharu Ito, No. 2-1, 2-Chome, Jin-nan, Shibuya-Ku, Tokyo; Kunitaka Arimura, No. 2-16, 2-Chome, Matsunami, Chigasaki-Shi, Kanagawa-Ken; Makoto Ando, No. 1-22, Deikicho, Kanazawa-Ku, Yokohama-Shi, Kanagawa-Ken; Tatsuya Shirai, No. 16-19, Den-enchofuhoncho, Ota-Ku, Tokyo; Ryuji Teramoto, No. 2613, Iiyama, Atsugi-Shi, Kanagawa-Ken, all of Japan

[21] Appl. No.: 708,353

[22] Filed: Mar. 5, 1985

[30] Foreign Application Priority Data

| | | | |
|---|---|---|---|
| Mar. 24, 1984 | [JP] | Japan | 59-56941 |
| Mar. 24, 1984 | [JP] | Japan | 59-56942 |
| Mar. 24, 1984 | [JP] | Japan | 59-56943 |
| Mar. 24, 1984 | [JP] | Japan | 59-56944 |

[51] Int. Cl.[4] ..... H01Q 13/12

[52] U.S. Cl. ..... 343/771; 343/770

[58] Field of Search ..... 343/770, 771, 780, 783, 343/785, 773

[56] References Cited

U.S. PATENT DOCUMENTS

| | | | |
|---|---|---|---|
| 2,659,003 | 11/1953 | Dorne et al. | 343/780 |
| 2,921,309 | 1/1960 | Elliott | 343/781 P |
| 2,929,064 | 3/1960 | Kelly | 343/771 |
| 3,235,869 | 2/1966 | Van Atta et al. | 343/785 |
| 4,536,767 | 8/1985 | Rembold et al. | 343/785 |
| 4,581,614 | 4/1986 | La Course | 343/771 |

FOREIGN PATENT DOCUMENTS

| | | | |
|---|---|---|---|
| 1616252 | 3/1978 | Fed. Rep. of Germany | 343/773 |
| 59-32205 | 2/1984 | Japan | 343/770 |

*Primary Examiner*—William L. Sikes
*Assistant Examiner*—Michael C. Wimer
*Attorney, Agent, or Firm*—Robert E. Burns; Emmanuel J. Lobato

[57] ABSTRACT

The present invention relates to telecommunication technology and broadcasting antenna technology. The power-feeding portion and the wave-guiding space, and the power-feeding wave-guiding space and the power-radiating wave-guiding space are matched for the effective radiation of the fed power. A conical matching body is disposed within the wave-guiding space with the apex thereof directed toward a power-feeding opening; the junction of the power-feeding wave-guiding space and the power-radiating wave-guiding space is formed in a sectional shape of a semicircle, a hemihedral polygon or a desired curvilinear shape; the power-feeding wave-guiding space the power-radiating wave-guiding space are matched in impedance; or a matching body is provided at the junction of the power-feeding wave-guiding space and the power-radiating wave-guiding space. A delaying means, such as a corrugated plate, is provided on the power-radiating surface or on a wall disposed opposite to the power-radiating surface, to radiate the power of the same phase uniformly with the reduced side lobe.

17 Claims, 17 Drawing Sheets

FLAT CIRCULAR UNIDIRECTIONAL MICROWAVE ANTENNA

BACKGROUND OF THE INVENTION

1. Field of the Invention

The present invention relates to a flat circular waveguide device suitable for use as a broadcasting antenna or the like.

2. Description of the Prior Art

A variety of flat circular waveguide devices have heretofore been proposed, including those having a coaxial cable, such as shown and indicated generally at "a" in FIG. 1. and those having a waveguide tube, such as shown and indicated generally at "b" in FIG. 2.

Incidentally, FIGS. 1 and 2 illustrate also the inner conductor c1 of a coaxial cable c, the outer conductor c2 of the same coaxial cable c, a waveguide tube d, an upper wall f formed of a metallic plate having slots g, a lower wall h formed of a metallic plate, a terminal resistor i, and a feeding opening j.

Either one of those conventional flat circular waveguide devices, however, has drawbacks that the feeding parts, such as the coaxial cable c and the waveguide tube d, do not match the wave-guiding space e, and thereby power is reflected by the junction of the coaxial cable c or the waveguide tube d, and the wave-guiding space e. Consequently, the power fed to the flat circular waveguide device cannot be radiated effectively.

A flat circular waveguide device as shown in FIGS. 3 and 4 is considered to enhance antenna gain and to enable the use of a small universal terminal resistor, by concentrating the power fed thereto in the central portion of the wave-guiding space so that the power is radiated uniformly through the power radiating opening. This flat circular waveguide device has, as shown in FIGS. 3 and 4, a pair of metallic plates b' and c', one of which having power-radiating slots a', disposed separately from and oppositely to each other, a metallic peripheral wall d' interconnecting the respective peripheries of those metallic plates b' and c' and defining, together with the metallic plates b' and c', an internal wave-guiding space e', and an intermediate metallic plate g' disposed within the wave-guiding space e' so as to form a by-pass gap f' between the periphery thereof and the metallic peripheral wall d', and is adapted to concentrate the power fed thereto from the peripheral wall d' doward the central portion of the wave-guiding space e' as indicated by an arrow Pf.

In FIGS. 3 and 4, also shown are a coaxial cable h', the outer conductor h1' of the coaxial cable, the inner conductor h2' of the coaxial cable, a terminal resistor i', and a conductive matching plate j'.

The flat circular waveguide device shown in FIGS. 3 and 4, however, has a drawback that the power fed thereto is reflected in the corner park k' of the wave-guiding space e' including the by-pass gap f' causing great difference between the upper wave-guiding compartment and the lower wave-guiding compartment in inner field, as shown in FIG. 5, and thereby the power supplied thereto cannot be radiated effectively through the corner part k'.

This flat circular waveguide device has a further drawback that the side lobe increases to deteriorate the antenna efficiency, because slots (or slits) a', i.e., power radiating openings, are arranged at an interval corresponding to the line wavelength λ to radiate power of the same phase through the slots.

SUMMARY OF THE INVENTION

The present invention has been made with a view to solve the above-mentioned problems of the conventional flat circular waveguide devices.

Accordingly, it is an object of the present invention to provide a flat circular waveguide device of a centerward power concerntrating type. In other words, the power is fed from the peripheral part of the wave guiding space towards the central part thereof. To achieve this type of power-feeding, there is provided an intermediate plate which serves to direct the fed power first to the peripheral part of the wave-guiding space and then from the peripheral part towards the central part of the wave-guiding space. This waveguide device is further provided with means for matching the power-feeding portion and the wave-guiding space to inhibit the reflection of the fed power.

It is another object of the present invention to provide a flat circular waveguide device having a peripheral wall formed in a specific form in the corner part to prevent the reflection of the fed power in the corner part so that the power fed thereto can effectively be radiated.

It is a further object of the present invention to provide a flat circular waveguide device in which wave-guiding compartments partitioned by an intermediate metallic plate are matched in respect of impedance to radiate the power fed thereto effectively.

It is a still further object of the present invention to provide a flat circular waveguide device capable of matching the power-feeding portion and the wave-guiding space, and of radiating power of the same phase, with a reduced side lobe.

Thus, a flat circular waveguide device, in a preferred embodiment, according to the present invention comprises a wave-guiding space enclosed by a metallic wall, and a power-feeding portion connected to a power-feeding opening formed so as to open into the wave-guiding space, and is characterized by a conical matching body disposed within the wave-guiding space with the apex thereof directed toward the power-feeding opening.

A flat circular waveguide device, in another embodiment, according to the present invention comprises a wave-guiding space enclosed by a metallic wall, a power-feeding portion connected to a power-feeding opening formed so as to open into the wave-guiding space, and a conical matching body disposed within the wave-guiding space with the apex thereof directed toward the power-feeding opening, and is characterized by an intermediate plate mounting the conical matching body, disposed within the wave-guiding space so as to form a by-pass gap between the periphery thereof and the metallic wall enclosing the wave-guiding space.

A flat circular waveguide device, in a further embodiment, according to the present invention comprises a wave-guiding space enclosed by a metallic wall, an intermediate plate disposed within the wave-guiding space so as to form a by-pass gap between the periphery thereof and the metallic wall, and a power-feeding portion connected to a power-feeding opening formed so as to open into the wave-guiding space, and is characterized in that the corner part of the wave-guiding space including the by-pass gap has a hemihedral polygonal, semicircular or desired curvilinear section to prevent the reflection of the fed power in the corner part.

A flat circular waveguide device, in a still further embodiment, according to the present invention comprises a wave-guiding space enclosed by a metallic wall, a power-feeding portion connected to a power-feeding opening formed so as to open into the wave-guiding space, a conical matching body disposed within the wave-guiding space with the apex thereof directed toward the power-feeding opening, and an intermediate plate mounting the matching body, disposed within the wave-guiding space so as to form a by-pass gap between the periphery thereof and the metallic wall, and is characterized in that the corner part of the wave-guiding space including the by-pass gap has a hemihedral polygonal, semicircular or desired curvilinear section to prevent the reflection of the fed power in the corner part.

A flat circular waveguide device, in further embodiment, according to the present invention comprises a wave-guiding space enclosed by a metallic wall, an intermediate plate disposed within the wave-guiding space so as to form a by-pass gap between the periphery thereof and the metallic wall, and a power-feeding portion connected to a power-feeding opening formed so as to open into the wave-guiding space, and is characterized in that the intermediate plate is disposed in the wave-guiding space so that wave-guiding compartments partitioned by the intermediate plate have the same impedance.

A flat circular waveguide device, in an even further embodiment, according to the present invention comprises a wave-guiding space enclosed by a metallic wall, an intermediate plate disposed within the wave-guiding space so that a by-pass gap is formed between the periphery thereof and the metallic wall, and a power-feeding portion connected to a power-feeding opening formed so as to open into the wave-guiding space, and is characterized in that a matching body having a desired impedance is disposed near the lower end wall of the intermediate plate (including the lower end wall) for use as the connection of the matching body to match the respective impedances of the wave-guiding compartments.

A flat circular waveguide device, in a still further embodiment, according to the present invention comprises a wave-guiding space enclosed by a metallic wall, a power-feeding portion connected to a power-feeding opening formed so as to open into the wave-guiding space, and a conical matching body disposed within the wave-guiding space with the apex thereof directed toward the power-feeding opening, and is characterized by a wave delaying means provided in the wave-guiding space between a power radiating surface and a wall surface facing the power radiating surface.

Accordingly, the flat circular waveguide device of the present invention has the following effects and advantages.

(1) The possiblity of the satisfactory matching of the power-feeding portion and the wave-guiding space enables the effective radiation of the fed power.

(2) The possibility of the satisfactory matching of one of the wave-guiding compartments partitioned by the intermediate plate and the corner part prevents the reflection of the fed power in the corner part and enables efficient power feeding.

(3) The disposition of the intermediate plate in the wave-guiding space so that the respective impedances of the wave-guiding compartments partitioned by the intermediate plate are the same enables effective power feeding.

(4) The possibility of matching the wave-guiding compartments partitioned by the intermediate plate in impedance improves power feeding efficiency.

(5) The prevention of the power reflection at the junction of the power-feeding portion and the wave-guiding space enables efficient radiation of the fed power.

(6) The possibility of effectively delaying the waves of the fed power, even when the intervals between the slots (power radiation openings) formed in the power radiating surface are smaller than the line wavelength λ, enables the radiation of power of the same phase through the slots at a high antenna efficiency with a reduced side lob.

BRIEF DESCRIPTION OF THE DRAWINGS

FIGS. 6 to 9 relate to a flat circular waveguide device of a coaxial cable type, in a first embodiment, according to the present invention, in which:

FIG. 6 is a perspective view in central longitudinal section;

FIG. 7 is a central longitudinal sectional view;

FIG. 8 is a graph showing the reflection characteristic of the device; and

FIG. 9 is a central longitudinal sectional view of a modified form, corresponding to FIG. 7;

FIGS. 10 to 13 relate to a flat circular waveguide device of a coaxial cable type, in a second embodiment, according to the present invention, in which:

FIG. 10 is a perspective view in central longitudinal section;

FIG. 11 is a central longitudinal sectional view;

FIG. 12 is a graph showing the reflection coefficient characteristic; and

FIG. 13 is a graph showing the power flux density characteristic along the radial direction in the upper wave-guiding compartment;

FIGS. 14 to 22 relate to a flat circular waveguide device of a coaxial cable type, in a third embodiment, according to the present invention, in which:

FIG. 14 is a perspective view in central longitudinal section;

FIG. 15 is a central longitudinal sectional view;

FIG. 16 is a graph showing the reflection coefficient characteristic;

FIG. 17 is a graph showing the inner field characteristic;

FIG. 18 is a graph showing the power flux density characteristic along the radial direction in the upper wave-guiding compartment;

FIG. 19 is a central longitudinal sectional view of a modified form, corresponding to FIG. 15;

FIGS. 20 and 21 are graphs of assistance to explaining the functions of the device of FIG. 19; and FIG. 22 is a central longitudinal sectional view of a further modified form, corresponding to FIG. 15;

FIGS. 23 to 29 relate to a flat circular waveguide device, in a fourth embodiment, according to the present invention, in which:

FIG. 23 is a central longitudinal sectional view;

FIGS. 24, 25(*a*), 25(*b*), 26 and 27 are fragmentary longitudinal sectional views showing partially modified forms respectively;

FIG. 28 is a central longitudinal sectional view of a further modified form, corresponding t FIG. 23; and FIG. 29 is a fragmentary longitudinal sectional view of a still further modified form;

FIGS. 30 to 35 relate to a flat circular waveguide device of a coaxial cable type, in a fifth embodiment, according to the present invention, in which:

FIG. 30 is a perspective view in central longitudinal section;

FIG. 31 is a central longitudinal sectional view;

FIG. 32 is a graph showing the reflection coefficient characteristic;

FIG. 33 is a graph showing the inner field characteristics;

FIG. 34 is a graph showing the power flux density characteristic along the radial direction in the upper wave-guiding compartment; and FIG. 35 is a central longitudinal sectional view of a modified form, corresponding to FIG. 31;

FIGS. 36 to 39 relate to a flat circular waveguide device of a coaxial cable type, in a sixth embodiment, according to the present invention, in which:

FIG. 36 is a perspective view in central longitudinal section;

FIG. 37 is a central longitudinal sectional view; and

FIG. 38 is a central longitudinal sectional view of a modified form, corresponding to FIG. 37;

FIG. 39 is a modified form of the matching body; and

DETAIL DESCRIPTION OF THE PREFERRED EMBODIMENTS

Preferred embodiments of the present invention will be described hereinafter in conjunction with the accompanying drawings.

Figure 1:
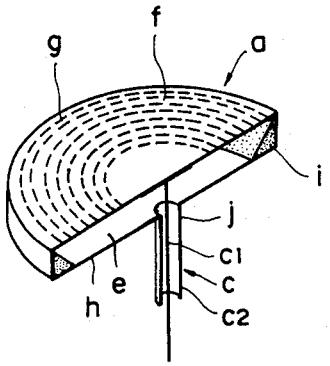
FIG. 1 PRIOR ART
FIG. 1 is a perspective view in central longitudinal section of a conventional flat circular waveguide device of a coaxial cable type.
Figure 2:
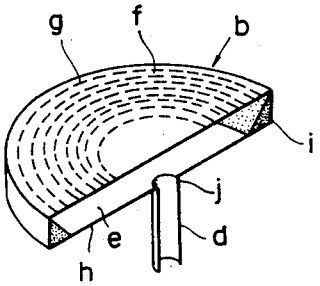
FIG. 2 PRIOR ART
FIG. 2 is a perspective view in central longitudinal section of a conventional waveguide tube type flat circular waveguide device.
Figure 3:
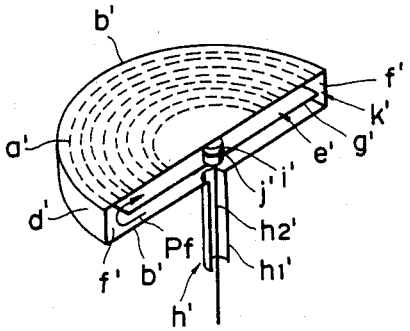
FIG. 3 PRIOR ART
FIGS. 3 and 4 are perspective view in central longitudinal section and a central longitudinal sectional view, respectively, of an improved flat circular waveguide device similar to those of FIGS. 1 and 2.
Figure 4:
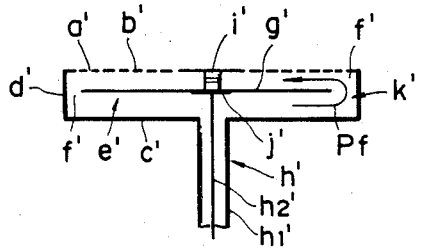
FIG.4 PRIOR ART
Figure 5:
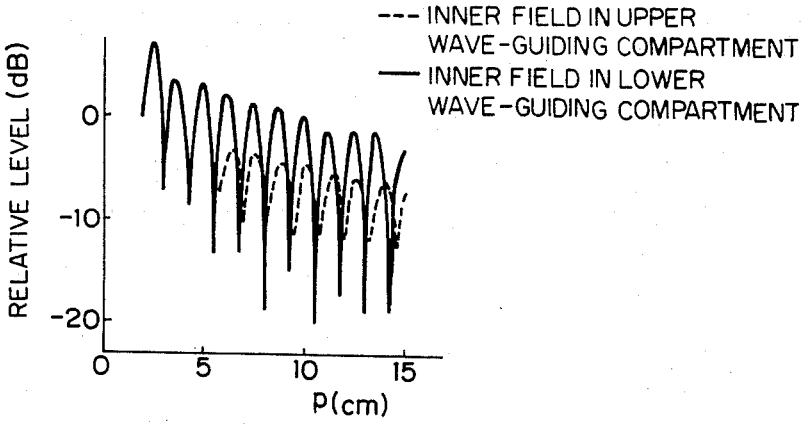
FIG.5 PRIOR ART
FIG. 5 is a graph showing the inner field characteristic of the wave-guiding space of the device of FIG. 3.
Figure 6:
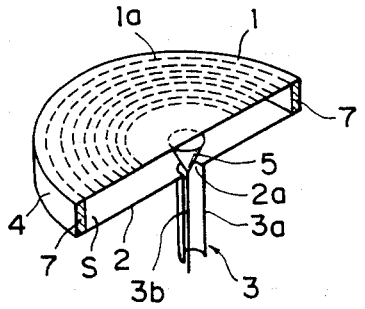
Figure 7:
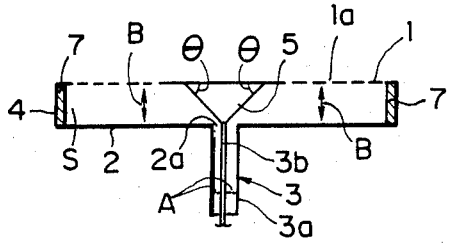

In the first embodiment, as shown in FIGS. 6 and 7, a pair of metallic disks 1 and 2 are disposed separately from and opposite to each other, and a plurality of slots (or slits) 1*a*, which function as power radiating openings, are formed in one of the metallic disk, namely, the metallic disk 1, in concentric circles or in a spiral.

A circular power feeding opening 2a is formed in the central part of the other metallic disk 2, coaxialy with the metallic disk 2. A coaxial cable 3, which functions as a power-feeding portion, is connected to the opening 2*a*.

A metallic peripheral wall 4 interconnects the metallic disks 1 and 2. The metallic disks 1 and 2 and the metallic peripheral wall 4 define a wave-guiding space S.

A metallic matching body 5 having the form of a circular cone of a base angle $\theta$ ($\approx 45°$) is disposed within the wave-guiding space S with the apex thereof directed toward the opening 2*a*, more specifically, the bottom of the matching body 5 is attached to the metallic disk 1 coaxially with the same, and hence the apex of the matching body coincides with the center axis of the opening 2*a*.

The outer conductor 3*a* and the inner conductor 3*b* of the coaxial cable 3 are connected to the opening 2*a* and the apex of the matching body 5 respectively.

In the flat circular waveguide device of the present invention thus constructed, the reflection of power at the junction of the coaxial cable 3 and the wave-guiding space S is prevented by the agency of the conical matching body 5, and thereby the fed power is radiated effectively.

Figure 8:
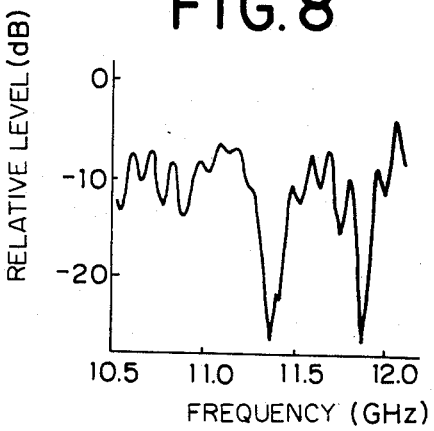

As apparent from the reflection coefficient characteristic at the opening 2*a* (connecting part) shown in FIG. 8, the reflection is reduced and the power is fed effectively.

Furthermore, the conical matching body 5 is capable of shifting the direction of the electric field accurately by 90° from the direction indicated by arrows A within the coaxial cable 3 shown in FIG. 7 to the direction indicated by arrows B in the wave-guiding space S as shown in FIG. 7, namely, the conical matching body 5 is capable of achieving accurate mode transformation, which further promotes the effective radiation of the fed power.

Figure 9:
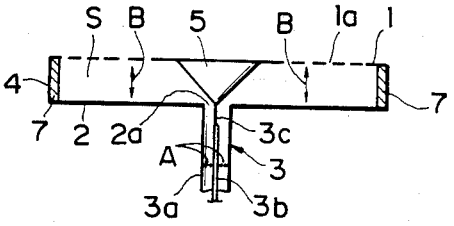

Referring to FIG. 9, when the thickness of the connecting end 3*c* of the inner conductor 3*b* connected to the apex of the conical matching body 5 is differentiated from that of the other part of the inner conductor 3*b*, for example, when the thickness of the connecting end 3*c* is smaller than the other part, and the length of the connecting end 3*c* is equal to a quarter of the line wavelength $\lambda$ so that the square $Z_{02}^2$ of the impedance $Z_{02}$ of the connecting end 3*c* is equal to the product $Z_{01} \cdot Z_{03}$ of the impedance $Z_{03}$ of the cable 3 and the impedance $Z_{01}$ of the wave-guiding space S, namely, when $Z_{02}^2 = Z_{01} \cdot Z_{03}$, the coaxial cable 3 and the wave-guiding space S are matched perfectly, which enhances the effective radiation of the fed power.

Thus the connecting end 3*c* having the thickness and the length meeting the above-mentioned condition functions as an impedance matching part.

In FIGS. 6 to 9, indicated at 7 is an annular terminal resistor.

Figure 10:
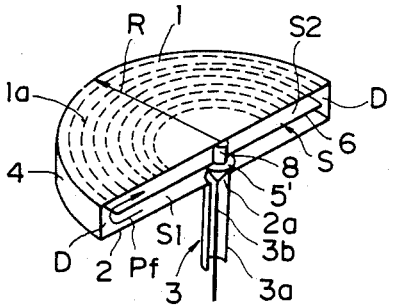
Figure 11:
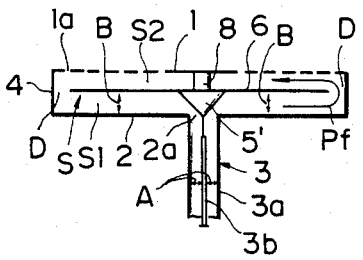

The second embodiment of the present invention will be described hereinafter. Referring to FIGS. 10 and 11, the second embodment is provided with an intermediate metallic plate 6 disposed within a wave-guiding space S defined by metallic walls so as to extend in parallel to metallic disks 1 and 2 and to form a by-pass gap D between the periphery thereof and a peripheral wall 4. The wave-guiding space S is partitioned by the intermediate metallic plate 6 into two wave-guiding compartments S1 and S2.

The intermediate metallic plate 6 is attached at a suitable position to the metallic disk 1 through a terminal resistor 8 disposed at the center of the disk or through an insulating plate.

A metallic matching body 5′ having the form of a circular cone of a base angle $\theta$ ($\approx 45°$) is disposed within the wave-guiding compartment S1, with the apex thereof directed toward an opening 2*a*. That is, the bottom of the matching body 5′ is attached to the intermediate metallic plate 6 concentrically therewith and the apex of the matching body 5′ coincides with the center axis of the opening 2*a*.

The outer conductor 3*a* and the inner conductor 3*b* of a coaxial cable 3 are connected, similarly to those of the first embodiment, to the opening 2*a* and the apex of the matching body 5′ respectively.

The second embodiment also is capable of inhibiting the reflection of power at the junction of the coaxial cable 3 and the wave-guiding space S (the lower wave-guiding compartment S1) by the agency of the conical matching body 5′ and of changing the direction of the electric field in the coaxial cable 3 (indicated by arrows A) accurately by 90° into the direction in the wave-guiding space S (indicated by arrows B) for mode transformation, and thereby the fed power can effectively be introduced into the lower wave-guiding compartment S1.

Figure 12:
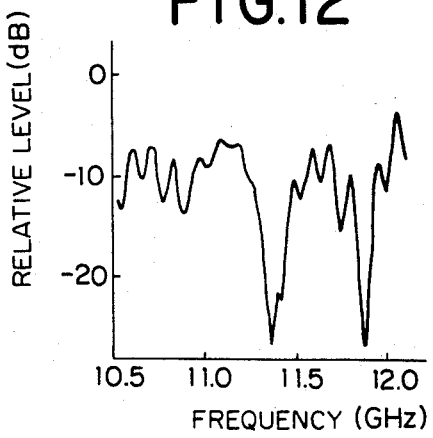

As apparent from the reflection coefficient characteristic at the opening 2*a* (connecting part) shown in FIG. 12, the reflection is reduced and the power is fed effectively.

Thus the power fed efficiently to the lower wave-guiding compartment S1 propagates, as indicated by an arrow Pf, from the lower wave-guiding compartment S1 through the by-pass gap D formed between the peripheral wall 4 and the intermediate metallic plate 5 into the upper wave-guiding compartment S2 and then toward the central part of the upper wave-guiding compartment S2.

Figure 13:
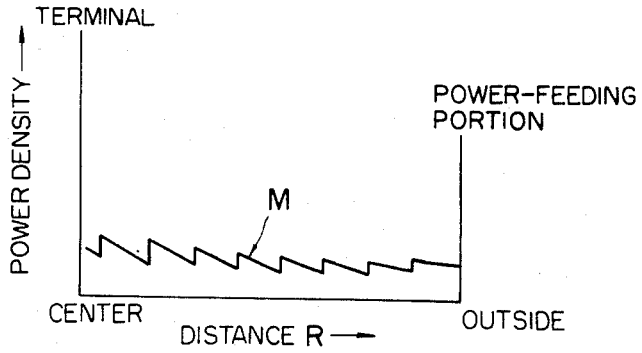

As the fed power propagates through the upper wave-guiding compartment S2, the power is radiated through the slots 1a formed in the metallic disk 1. The power density characteristic M of the radiated power is represented by an almost saw-tooth curve in FIG. 13. The characteristic M assumes the appearance of an almost saw-tooth curve, which is due to the sudden drop of the power density upon the radiation of power through the slots 1*a*. However, since the power is fed from the periphery toward the central area, the level of the characteristic M, in general, is smooth and practically the same for every positio regardless of the distance R from the terminal. That is, the flat circular waveguide device of the present invention is capable of transmitting the fed power into the wave-guiding space S without loss and of radiating the power uniformly, and hence the antenna gain is enhanced remarkably.

Figure 14:
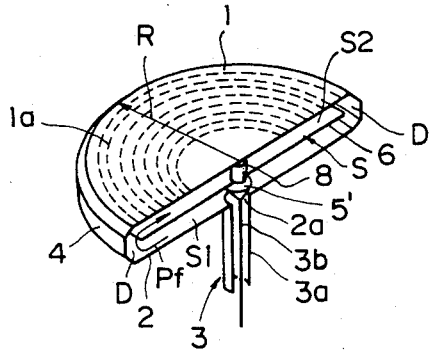
Figure 15:
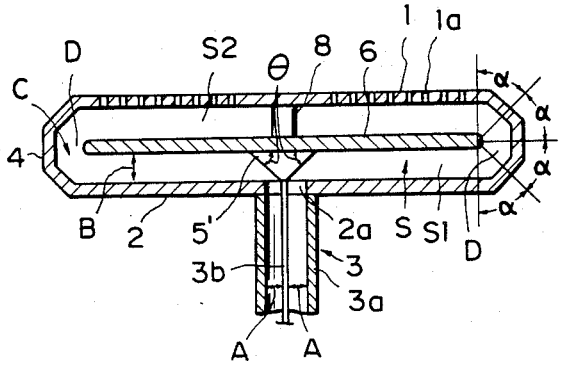

The third embodiment of the present invention will be described hereinafter. As shown in FIGS. 14 and 15, the third embodiment, similarly to the above-mentioned embodiments, has a pair of metallic disks 1 and 2 disposed separately from and opposite to each other, and a plurality of slots (or slits) 1*a*, which function as power radiating openings, are formed in concentric circles or in a spiral in the metallic disk 1.

A power feeding opening 2*a* connected to a coaxial cable 3, which functions as a power-feeding portion, is formed in the other metallic disk 2.

The metallic disks 1 and 2 are interconnected along the peripheries thereof by a metallic peripheral wall 4. The metallic disks 1 and 2, and the metallic peripheral wall 4 define internally a wave-guiding space S.

An intermediate metallic plate 6 is disposed within the wave-guiding space S so as to form a by-pass gap D between the periphery thereof and the peripheral wall 4 and to partition the wave-guiding space S into two wave-guiding compartments S1 and S2.

The intermediate metallic plate 6 is attached, at a suitable position, to the metallic disk 1 through a terminal resistor 8 disposed at the center of the metallic disk 1 or through an insulating plate.

A metallic matching body 5′ having the form of a circular cone of a base angle of approximately 45° is disposed within the wave-guiding compartment S1, with the apex thereof directed to the opening 2*a*. The bottom of the matching body 5′ is attached concentrically to the intermediate metallic plate 6 so that the apex of the matching body 5′ coincides with the center axis of the opening 2*a*.

As in the above-mentioned embodiments, the outer conductor 3*a* and the inner conductor 3*b* of a coaxial cable 3 are connected to the opening 2*a* and to the apex of the matching body 5′ respectively.

The third embodiment also is capable, by the agency of the conical matching body 5′, of inhibiting the reflection of power at the junction of the coaxial cable 3 and the wave-guiding space S (the lower wave-guiding compartment S1) and of shifting the direction of the electric field in the coaxial cable 3 as indicated by arrows A accurately by 90° to the direction of the electric field in the wave-guiding space S as indicated by arrows B in FIG. 15, and thereby the fed power, for example, can be introduced effectively into the lower wave-guiding compartment S1.

Figure 16:
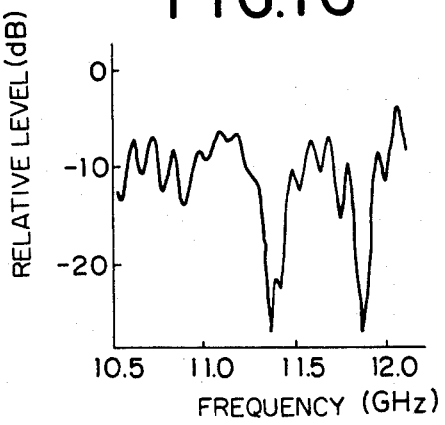

As apparent from the reflection coefficient characteristic at the opening 2*a* (connecting part) shown in FIG. 16, the reflection is reduced and the power is fed effectively.

Differently from the wave-guiding space of the second embodiment, the corner part C of the wave-guiding space S including the by-pass gap D has a half-octangular or semicircular section. This morphology of the corner part C is capable of full inhibition of the reflection of the fed power and effective transmission of the fed power through the corner part C.

Figure 17:
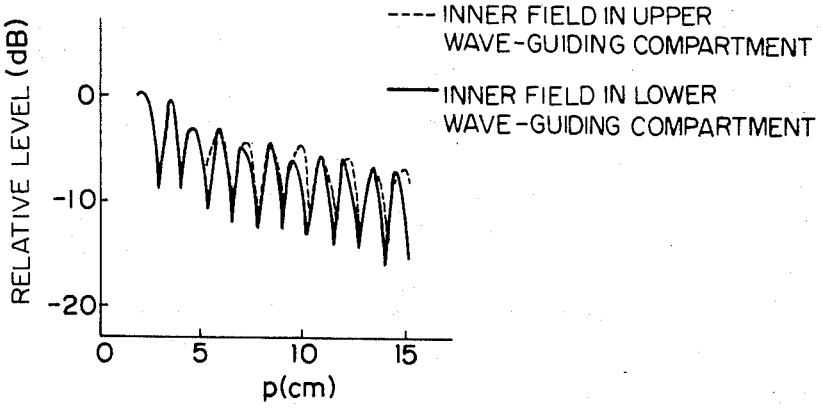

FIG. 17 shows the inner field characteristic of the lower wave-guiding compartment S1 and that of the upper wave-guiding compartment S2 by continuous line and broken line respectively. As apparent from FIG. 17, the respective inner fields of the wave-guiding compartments S1 and S2 are practically equal to each other, which demonstrates that the power is not reflected in the corner part C.

The intermediate metallic plate 6 is disposed so that the respective impedances Zd and Zu of the wave-guiding compartments S1 and S2 are equal to each other, for example, at the middle between the metallic disks 1 and 2, and thereby the wave-guiding compartments S1 and S2 are matched in impedance, and hence further effective power feeding is possible.

Accordingly, the power fed efficiently to the lower wave-guiding compartment S1 propagates efficiently, as indicated by an arrow Pf, from the lower wave-guiding compartment S1 via the by-pass gap D formed between the periphery of the intermediate metallic plate 6 and the peripheral wall 4, namely, the corner part C, into the upper wave-guiding compartment S2, and then propagates toward the central area.

Figure 18:
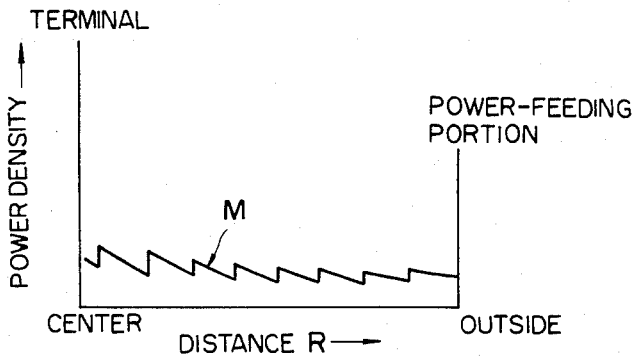

As the fed power propagates through the upper wave-guiding compartment S2, the power is radiated through the slots 1a formed in the metallic disk 1. The power density characteristic is represented by a curve indicated at M in FIG. 18. This characteristic M assumes an almost saw-tooth curve, similarly to those of the above-mentioned embodiments, which is due to the sudden drop of the power density upon the radiation of the power through the slots 1*a*. However, since power is fed from the periphery toward the central area also in this embodiment, the level of the characteristic M, in general, is smooth and practically the same for every position regardless of the distance R from the terminal.

This flat circular waveguide device, i.e., the third embodiment, is capable of effective introduction of the fed power into the wave-guiding space S, efficient transmission of the power via the corner part C, and uniform radiation of the power, and hence the antenna gain is enhanced remarkably.

Figure 19:
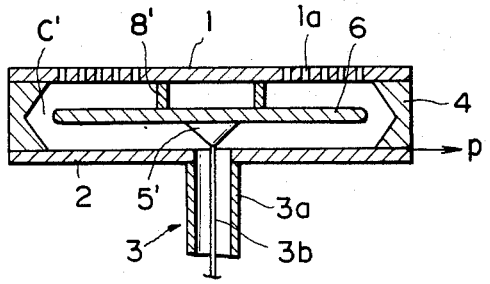
Figure 20:
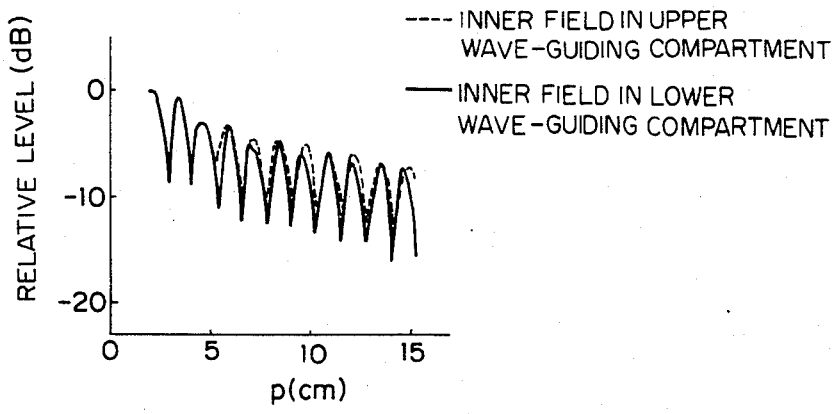

Furthermore, in a modification, the inside surface of the peripheral wall 4 may be a double-tapered surface to form a corner part C' as illustrated in FIG. 19, to facilitate the transmission of the electromagnetic wave through the corner part C'. This corner part C' is capable of satisfactorily inhibiting the reflection of the fed power, which is apparent from the approximate coincidence of the respective inner fields of both the wave-guiding compartments, as shown in FIG. 20.

Figure 21:
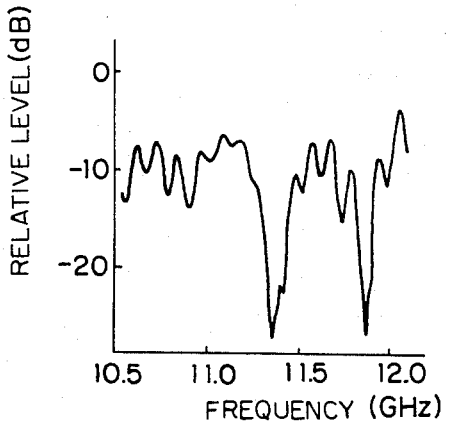

The reflection coefficient characteristic at the opening 2*a* (connecting part) is shown in FIG. 21. It is apparent also from FIG. 21 that the fed power is radiated effectively by the agency of the conical matching body 5'. In FIG. 19, indicated at 8' is a terminal resistor.

Figure 22:
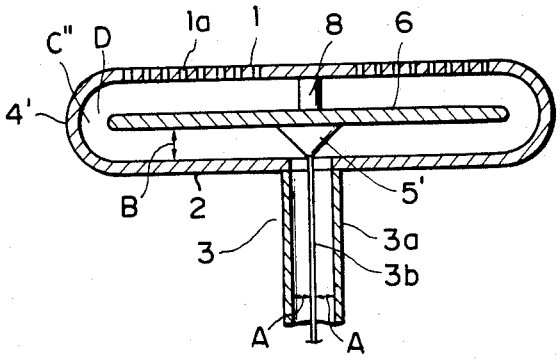

Furthermore, a corner part C'', including the by-pass gap D, of a semicircular section as illustrated in FIG. 22 is capable of satisfactorily inhibiting the reflection of the fed power. A corner part having a smooth semicircle-like curvilinear section causes less reflection of the fed power. In FIG. 22, indicated at 4' is a peripheral wall.

The fourth embodiment of the present invention will be described hereinafter. In the fourth embodiment, illustrated in FIG. 23, the respective impedances Zu and Zd of wave-guiding compartments S1 and S2 are different from each other ($Zu \neq Zd$). A matching part 6*a* of an impedance Zm ($Zm^2 = Zu \cdot Zd$) and a length l (l = a quarter of the line wavelength λ employed for transmitting and receiving power in the device) is formed in the periphery of an intermediate metallic plate 6, to match the wave-guiding compartments S1 and S2 in impedance for effective power feeding.

Figure 24:
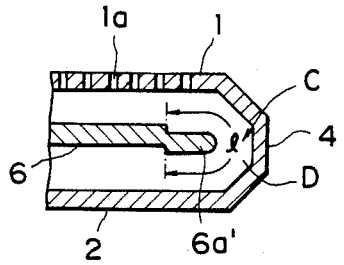
Figure 25A:
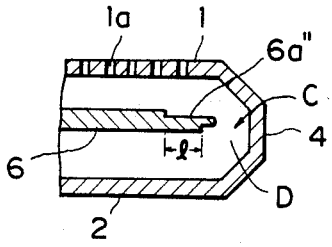
Figure 25B:
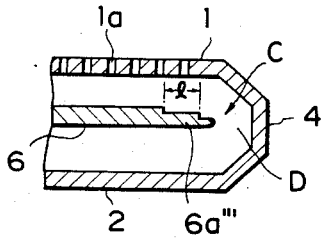

A matching part 6*a'*, 6*a''* or 6*a'''* shown in FIGS. 24, 25(*a*) and 25(*b*) may be formed in the intermediate metallic plate 6 to match the wave-guiding compartments S1 and S2 in impedance.

The matching parts 6*a'*, 6*a''* and 6*a'''* need to be formed so that the impedance Zm thereof meets an equality $Zm^2 = Zu \cdot Zd$, in which the length l is equal to a quarter of the line wavelength λ employed for transmitting and receiving power in the device.

Figure 26:
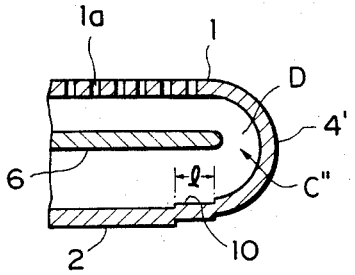

Furthermore, as shown in FIG. 26, the peripheral portion 10 of the metallic disk 2, merging into the peripheral wall 4' of a semicircular section and having a width l corresponding to a quarter of the line wavelength λ employed for transmitting and receiving power in the device may be offset inward toward the corner part C'' in the form of steps to employ the peripheral portion 10 as a matching part. In this case also, the impedance Zm of the peripheral portion 10 needs to meet an equality $Zm^2 = Zu \cdot Zd$.

Figure 27:
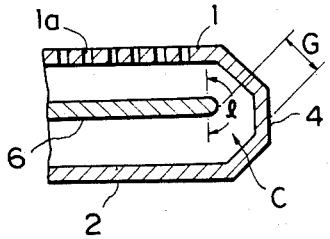

The impedance Zm of the corner part C may be decided so as to meet an equality $Zm^2 = Zu \cdot Zd$, by properly adjusting the by-pass gap D in the corner part C having a length l corresponding to a quarter of the line wavelength λ employed for transmitting and recieving power in the device and the value of a dimension G as shown in FIG. 27.

Figure 23:
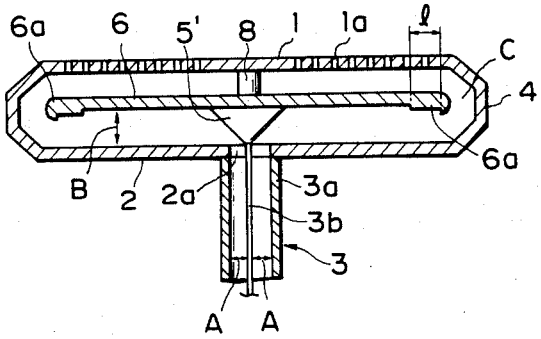

In the case of a modification illustrated in FIG. 23, for instance, the impedance of the upper wave-guiding compartment S2 includes that of the corner part C.

Figure 28:
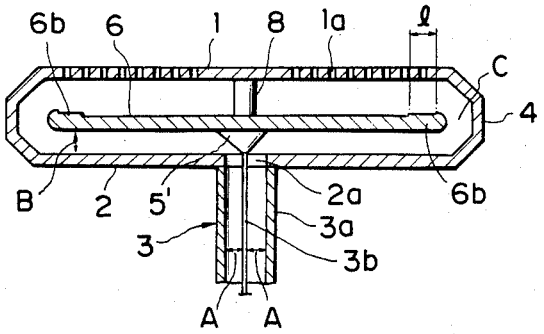
Figure 29:
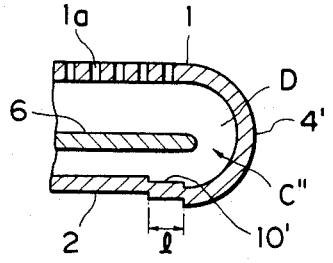

In the constructions shown in FIGS. 23 to 26, $Zu < Zd$, whereas in the constructions shown in FIGS. 28 and 29, $Zu > Zd$.

In a modification shown in FIG. 28, a matching part 6*b* of an impedance Zm ($Zm^2 = Zu \cdot Zd$) and a length l corresponding to a quarter of the line wavelength λ employed for transmitting and receiving power in the device is formed in the periphery of the intermediate metallic plate 6, to match the wave-guiding compartments S1 and S2 in impedance.

In a modification shown in FIG. 29, the peripheral portion 10' of the metallic disk 2, merging into the peripheral wall 4' of a semicircular section and having a width l corresponding to a quarter of the line wavelength λ employed for transmitting and receiving power in the device is offset outward toward the corner part C'' in the form of steps to employ the peripheral portion 10' as a matching part. In this case also, the impedance Zm of the peripheral portion 10' is decided so as to meet an equality $Zm^2 = Zu \cdot Zd$.

In the constructions shown in FIGS. 28 and 29, the impedance of the upper wave-guiding compartment S2 includes those of the corner parts C and C'' respectively.

The sectional shape of the corner part may be any polygonal shape other than a regular-octagonal shape.

Figure 30:
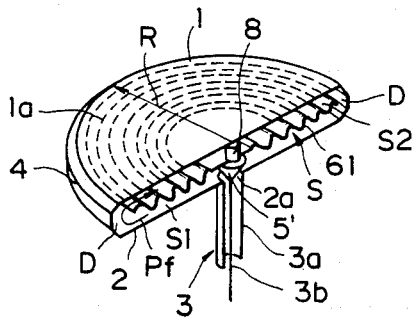
Figure 31:
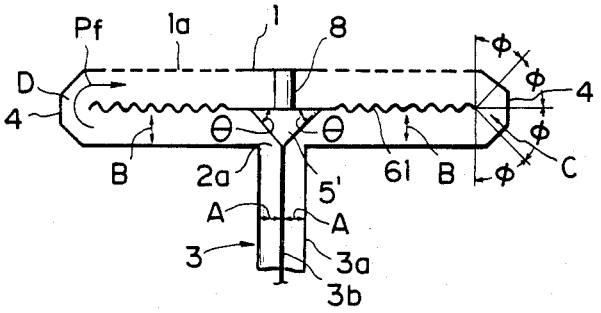

The fifth embodiment of the present invention will be described hereinafter. Referring to FIGS. 30 and 31, the fifth embodiment also has a pair of metallic disks 1 and 2 disposed separately from and opposite to each other. A plurality of slots (or slits) 1*a* are formed in the metallic disk 1 in concentric circles or in a spiral to form a power radiating surface in the metallic disk 1.

A power-feeding opening 2*a* connected to a coaxial cable 3, which functions as a power feeding portion, is formed in the other metallic disk 2. These metallic disks 1 and 2 are interconnected along the peripheries thereof by a metallic peripheral wall 4 to define a wave-guiding space S internally.

An intermediate metallic plate 61 is disposed within the wave-guiding space S in parallel to the metallic disks 1 and 2 so as to form a by-pass gap D between the periphery thereof and the peripheral wall 4 and to partition the wave-guiding space S into two wave-guiding compartments S1 and S2.

The intermediate metallic plate 61 is attached, at a suitable position, through a terminal resistor 8 disposed at the center of the disk, or through an insulating plate to the metallic disk 1.

A metallic matching body 5' having the form of a circular cone of a base angle of approximately 45° is disposed in the wave-guiding compartment S1, with the apex thereof directed toward the opening 2*a*. The bottom of the matching body 5' is attached concentrically to the intermediate metallic plate 61 so that the apex of the matching body 5' coincide with the center axis of the opening 2*a*.

The outer conductor 3*a* and the inner conductor 3*b* of the coaxial cable 3 are connected to the opening 2*a* and the apex of the matching body 5' respectively.

The fifth embodiment is capable, by the agency of the conical matching body 5', of inhibiting the reflection of power at the junction of the coaxial cable 3 and the wave-guiding space S (the lower wave-guiding compartment S1) and of shifting the direction of the electric field in the coaxial cable 3 as indicated by arrows A accurately by 90° to the direction of the electric field in the wave-guiding space S as indicated by arrows B in FIG. 31, for mode transformation, and thereby the fed power can be effectively introduced into the lower wave-guiding compartment S1.

Figure 32:
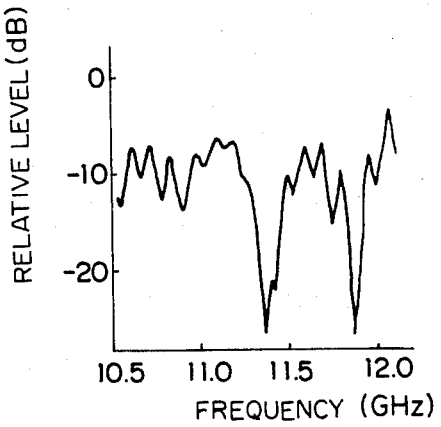

FIG. 32 shows a reflection coefficient characteristic at the opening 2*a* (connecting part). It is obvious from FIG. 32 that power reflection is reduced and power is fed effectively.

Since the sectional shape of the corner part C of the wave-guiding space S including the by-pass gap D has the shape of a semicircle or the half of a regular octagon, the power reflection in the corner part C can satisfactorily be inhibited, and hence the power can effectively be fed via the corner part C.

Figure 33:
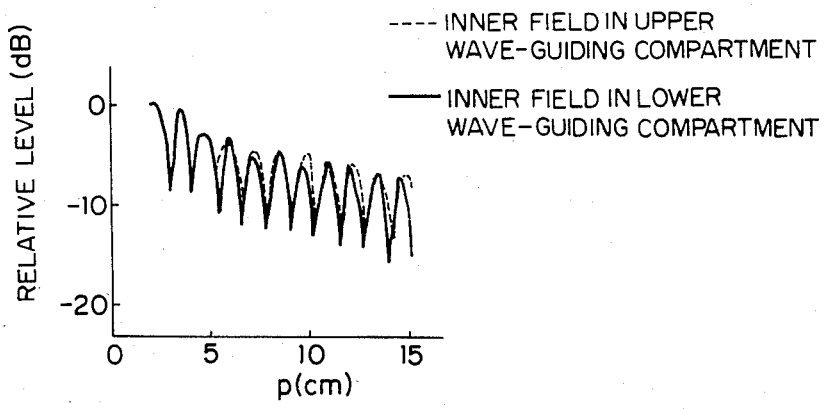

The respective modes of inner fields within the wave-guiding compartments S1 and S2 are shown in FIG. 33. As apparent from FIG. 33, the respective inner fields in the wave-guiding compartments S1 and S2 are practically the same, which demonstrates a fact that the power is not reflected in the corner part C.

The intermediate metallic plate 61 is disposed so that the respective impedances Zd and Zu of the wave-guiding compartments S1 and S2 are equal to each other, for example, at the middle between the metallic disks 1 and 2, and thereby the wave-guiding compartments S1 and S2 are matched in impedance for further effective power feeding.

Accordingly, the power thus fed efficiently to the lower wave-guiding compartment S1 propagates efficiently, as indicated by an arrow Pf, via the by-pass gap D formed between the periphery of the intermediate metallic plate 61 and the peripheral wall 4, i.e., the corner part C, into the upper wave-guiding compartment S2, and then propagates toward the central area.

Incidentally, it is desirable to arrange the slots 1*a* at an interval smaller than the line wavelength λ, for example 0.5 to 0.9 times the line wavelength, to reduce the side lobe, therefore, the slots 1a of the fifth embodiment are arranged accordingly.

However, if the intermediate metallic plate is a flat plate such as those employed in the above-mentioned embodiments, the phase of the power radiated through each slot 1a is different from the others, which is undesirable.

Accordingly, the fifth embodiment employs an intermediate metallic plate 61 formed by a corrugated plate which serves as a wave delaying means, to delay the electromagnetic waves introduced into the upper wave-guiding compartment S2 by the intermediate metallic plate 61 so that power of the same phase can be radiated through the slots 1a which are arranged at a small interval as mentioned above.

Thus the power of the same phase is radiated, with the side lobe reduced.

Figure 34:
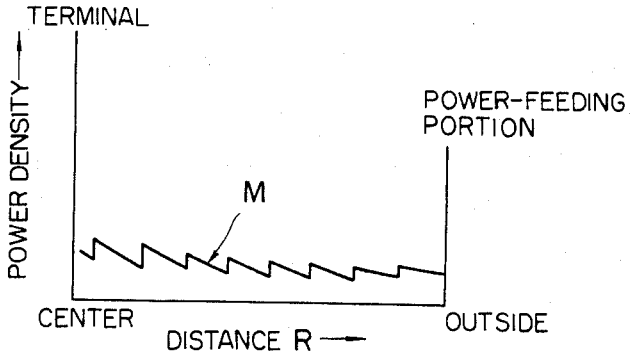

The power density characteristic in such manner of power radiation is indicated at M in FIG. 34. The characteristic M is represented by an almost saw-tooth curve, which is due to the sudden drop of the power density upon the radiation of power through the slots 1*a*. However, since the power is fed from the periphery toward the central area, the level of the characteristic M, in general, is smooth and practically the same for every position, regardless of the distance R from the terminal. Accordingly, the flat circular waveguide device, namely, the fifth embodiment of the present invention, is capable of introducing the fed power effectively into the wave-guide space S, of transmitting the fed power efficiently via the corner part C, and of radiating the power of the same phase uniformly with the side lobe reduced. Consequently, the antenna gain is enhanced remarkably.

Figure 35:
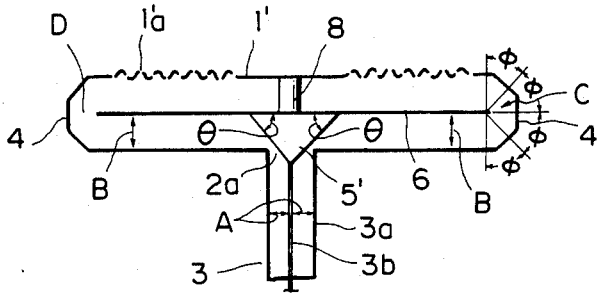

A modification having a conventional intermediate metallic plate 6 formed by a flat plate and a metallic disk 1′ having a power radiating surface and made of a corrugated plate for delaying waves, as shown in FIG. 35, has the same effects and advantages as those of the device shown in FIGS. 30 and 31.

Since the corrugated metallic disk 1′ is capable of delaying the electromagnetic wave, the radiation of the power of the same phase is possible, even if the slots 1*a*′ are arranged at a small interval (0.5 λ to 0.9 λ) to reduce the side lobe.

Although all the delaying circuits shown herein are corrugated lines, artificial dielectrics having the same effects, such as a comb-type circuit in which the metallic disk, instead of being corrugated, has concentric ribs having the appearance in cross section of the teeth of a comb, may be employed as the delaying circuits (means).

An insulating material of a high dielectric constant also provides the same effects, however, such an insulating material, in general, causes a dielectric loss, while an insulating material which causes only a small dielectric loss is, at present, expensive. Therefore, an artificial dielectric is a desirable delaying means.

The device shown in FIGS. 30 and 31 employs a corrugated intermediate plate, delaying occurs in both the wave-guiding compartments S1 and S2. However, delaying is unnecessary in the lower wave-guiding compartment S1 and the loss is increased somewhat by the corrugation. Therefore, it is preferable to form the intermediate plate facing the lower wave-guiding compartment S1 by flat surface as far as the manufacturing process permits. Naturally, when a low-loss dielectric is employed, the dielectric is provided only in the upper wave-guiding compartment S2.

Figure 36:
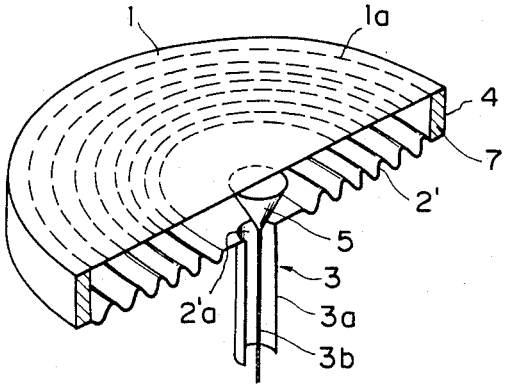
Figure 37:
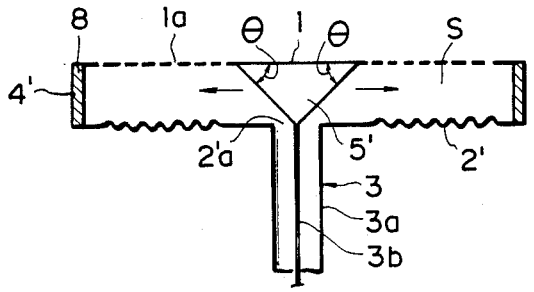
Figure 38:
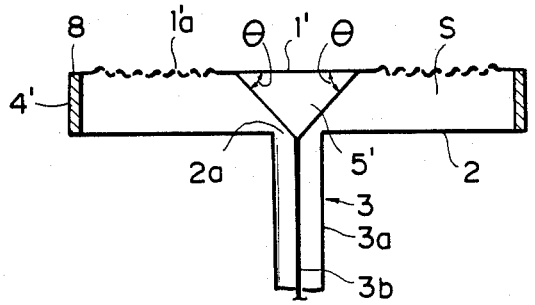

Now, the sixth embodiment of the present invention will be described hereinafter. Referring to FIGS. 36 to 38, the sixth embodiment is not provided with any intermediate metallic plate, such as the intermediate metallic plate 61 employed in the fifth embodiment. In the sixth embodiment, the fed power propagates from the central area toward the peripheral area.

The sixth embodiment also is provided with a metallic matching body 5 having the form of a circular cone of a base angle of approximately 45° disposed, as shown in FIGS. 36 and 37, within the wave-guiding space S, with the apex thereof directed toward an opening 2*a*. The bottom of the matching body 5 is attached concentrically to a metallic disk 1. Consequently, the apex of the matching body coincides with the center axis of the opening 2*a*.

The conical matching body 5 inhibits the reflection of the power at the junction of the wave-guiding space S and a coaxial cable 3, and enables the effective introduction of the fed power into the wave-guiding space S.

In the case of the sixth embodiment also, slots 1*a* are formed in the metallic disk 1 at an interval smaller than the line wavelength λ, namely, at an interval corresponding to 0.5 λ to 0.9 λ to reduce the side lobe. A metallic disk 2′ disposed opposite to the metallic disk 1 is formed by a corrugated plate for delaying the electromagnetic wave. Accordingly, the electromagnetic wave introduced into the central area of the wave-guiding space S is delayed appropriately by the corrugated metallic disk 2′ as the same propagates toward the peripheral area of the wave-guiding space S being radiated through the slots 1*a* in the power of the same phase. Finally, a terminal resistor 7 absorbs the terminated energy which does not radiate from the slots and remains in the wave-guiding space.

In a modification as shown in FIG. 38, the metallic disk 2 is formed by an ordinary flat plate, while the metallic disk 1' having the power radiating surface is formed by a corrugated plate. This constitution is capable of providing practically the same effects and advantages as those of the constitution shown in FIGS. 36 and 37. That is, since the electromagnetic wave is delayed by the corrugated metallic disk 1', the radiation of the power of the same phase is possible, even if the slots 1a are arranged at a small interval (0.5λ to 0.9λ) to reduce the side lobe.

In FIGS. 36 to 38, there are also shown a cylindrical peripheral wall 4, a power feeding opening 2'*a*, and an annular terminal resistor 7.

The embodiments described hereinbefore may employ, instead of the member having the slots 1*a*, a printed circuit board with slots 1*a* printed thereon. When such a printed circuit board is employed, the same is disposed with the substrate thereof turned outward. Furthermore, the substrate may be covered with a cover.

Furthermore, the above-mentioned embodiments may employ, instead of the metallic disks 1 and 2, the metalic peripheral wall 4 or 4' and the intermediate metallic plate 6 or 61, plastic components plated with a metal over the surfaces or the inner peripheries to form the wave-guiding space.

Figure 39:
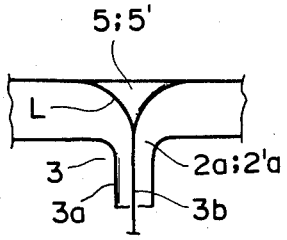

Furthermore, the matching bodies 5 and 5' may have a form having a longitudinal section defined by contours L of an exponential curve as shown in FIG. 39, instead of a circular cone. When a matching body of such a form is used, the connecting end of the outer conductor 3*a* of the coaxial cable to be connected to the opening 2*a* or 2'*a* may be extended in the form of an expornential curve.

The matching bodies 5 and 5' may be either solid or hollow, need not necessarily consisting entirely of a metal and may be members coated at least over the surface with a metallic layer.

Figure 40:
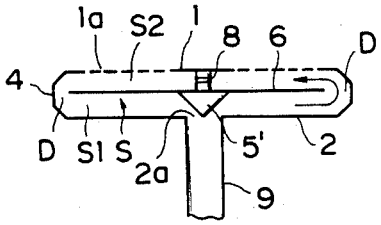
FIGS. 40 and 41 are central longitudinal sectional views of waveguide tube type flat circular waveguide devices, in a seventh and an eighth embodiment, respectively, according to the present invention.
Figure 41:
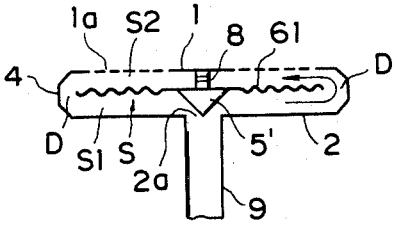

Now, the seventh and the eighth embodiment of the present invention will be described hereinafter. In these embodiments, a waveguide tube 9 is employed as a power-feeding portion as shown in FIGS. 40 and 41, instead of a coaxial cable 3. These embodiments provide the same effects as those provided by the above-mentioned embodiments.

In the case of the eighth embodiment shown in FIG. 41, the corrugation that functions as a delaying circuit has the form of concentric circles to deal with radial current. In the waveguide tube mode, sometimes, linear corrugation, namely, linear grooves, are used.

In FIGS. 7, 15, 31, 35, 37 and 38, the angles $\theta$, $\alpha$ and $\phi$ are approximately 45° respectively.

What is claimed is:

1. A flat circular undirectional microwave antenna comprising a wave-guide space formed inside a flat cylinder having a peripheral wall and inner and outer end plates of which the internal surface is made of metal, said outer end plate defining a plurality of openings for radiation of power therethrough while said inner end plate defines a central power-feeding opening connected to power-feeding means, an intermediate plate of metal at least on the surface thereof and attached to said cylinder by way of a spacer in such manner as to partition off upper and lower wave-guiding compartments and form a by-pass gap between the periphery of said intermediate plate and the peripheral wall of said cylinder, said gap constituting a junction between said upper and lower wave-guiding compartments, said intermediate plate together with said peripheral wall and end plates defining a power-feeding passage from said power-feeding opening to said power-radiating openings, and matching means for inhibiting the reflection of fed power from said power-feeding opening through said by-pass gap to said power-radiating openings in said outer end plate, said matching means comprising first matching means disposed on said intermediate plate near said power-feeding opening and second matching means disposed near said by-pass gap, said first matching means being constituted by a conical matching body at the power-feeding means attached to said intermediate plate and having the apex thereof directed toward said power-feeding opening.

2. A flat circular unidirectional microwave antenna according to claim 1, wherein said second matching means is constituted in such a way that the cross sectional shape of the peripheral wall of said cylinder, surrounding said by-pass gap in said power-feeding passage, is a semicircle.

3. A flat circular unidirectional microwave antenna according to claim 1, wherein said second matching means is constituted in such a way that the cross sectional shape of the peripheral wall of said cylinder, surrounding said by-pass gap in said power-feeding passage, is a hemihedral polygon.

4. A flat circular unidirectional microwave antenna according to claim 1, wherein said first matching means is constituted in such a way that said conical matching body at the power-feeding means is attached to said intermediate plate, the apex of the conical matching body at the power-feeding means is directed toward said power-feeding opening, and said second matching means comprises the cross sectional shape of the peripheral wall of said cylinder, surrounding said by-pass gap in said power-feeding passage, being a semicircle.

5. A flat circular unidirectional microwave antenna according to claim 1, wherein said first matching means is constituted in such a way that said conical matching body at the power-feeding means is attached to said intermediate plate, the apex of the conical matching body at the power-feeding means is directed toward said power-feeding opening, and said second matching means comprises the cross sectional shape of the internal surface of the peripheral wall of said cylinder, surrounding said by-pass gap in said power-feeding passage, being a hemihedral polygon.

6. A flat circular unidirectional microwave antenna according to claim 1, wherein said second matching means is constituted in such a way that said intermediate plate is disposed so that said wave-guide space is partitioned into two wave-guide compartments of the same impedance.

7. A flat circular unidirectional microwave antenna according to claim 1, wherein said intermediate plate is disposed midway between the end plates of said cylinder.

8. A flat circular unidirectional microwave antenna according to claim 1, wherein said second matching means is constituted in such a way that a matching body at an intermediate portion of said power-feeding passage having a desired impedance is disposed near the junction of said upper and lower wave-guiding compartments partitioned off by said intermediate plate in order to match said upper and lower wave-guiding compartments in impedance.

9. A flat circular unidirectional microwave antenna according to claim 1, wherein a matching body at an intermediate portion of said power-feeding passage is formed in the periphery of said intermediate plate and has a length corresponding to a quarter of a line wavelength employed for transmitting and receiving power and an impedance Zm equal to the square root of the product of the impedance Zu of the upper wave-guiding compartment and the impedance Zd of the lower wave-guiding compartment, namely, an impedance Zm in accordance with the equation, $Zm=\sqrt{Zu \cdot Zd}$.

10. A flat circular unidirectional microwave antenna according to claim 8, wherein said matching body at an intermediate portion of said power-feeding passage is formed in the inside of the peripheral wall of said cylinder extending adjacently to a junction of said wave-guiding compartments and the matching body at an intermediate portion of said power-feeding passage has a length corresponding to a quarter of a line wavelength $\lambda$ employed for transmitting and receiving power and an impedance Zm equal to the square root of the product of the impedance Zu of the upper wave-guiding compartment and the impedance Zd of the lower wave-guiding compartment, namely, an impedance Zm meeting an equality $Zm=\sqrt{Zu \cdot Zd}$.

11. A flat circular unidirectional microwave antenna according to claim 8, wherein a junction of said wave-guiding compartments is formed so as to function as a matching body at an intermediate portion of said power-feeding passage, said matching body having a length corresponding to a quarter of a line wavelength $\lambda$ employed for transmitting and receiving power and an impedance Zm in accordance with the equation:

$Zm=\sqrt{Zu \cdot Zd}$ where Zu is the impedance of the upper wave-guiding compartment and Zd is the impedance of the lower wave-guiding compartment.

12. A flat circular unidirectional microwave antenna according to claim 1, wherein said outer end plate defining said wave-guide space serves as a power radiating surface and said power radiating surface is a printed circuit board having openings for power radiating printed thereon.

13. A flat circular unidirectional microwave antenna according to claim 12, wherein said printed circuit board is disposed so that the substrate thereof is turned outwards.

14. A flat circular unidirectional microwave antenna according to claim 1, wherein the internal surface of said cylinder defining the wave-guide space is plated with metal and said cylinder proper is made of plastic material.

15. A flat circular unidirectional microwave antenna comprising a wave-guide space formed inside a flat cylinder having a peripheral wall and two end plates of which the internal surface is made of metal, one end plate defining a plurality of openings for radiation of power therethrough while the other end plate defines a power-feeding opening connected to a power-feeding means, an intermediate plate of which at least the outside surface thereof is of metal, said plate being attached to said cylinder by way of a spacer in such a manner that a by-pass gap is formed between the periphery thereof and the peripheral wall of said cylinder, said intermediate plate together with said peripheral wall and end plates defining a power-feeding passage from said power feeding opening to said power-radiating openings, matching means for inhibiting the reflection of fed power from said power-feeding opening, said matching means comprising first matching means disposed on said intermediate plate near said power-feeding opening and comprising a conical matching body provided centrally on said intermediate plate and having an apex directed toward said power-feeding opening and second matching means disposed near said by-pass gap, and delaying means for delaying electromagnetic waves provided within the wave-guide space, between a power radiating surface and a wall surface extending opposite to the power radiating surface.

16. A flat circular unidirectional microwave antenna according to claim 15, wherein said delaying means is formed by a corrugated plate.

17. A flat circular unidirectional microwave antenna according to claim 15, wherein said second matching means comprises an impedance at the periphery of said intermediate plate.

* * * * *